US007686586B2

(12) United States Patent
Nikpour

(10) Patent No.: US 7,686,586 B2
(45) Date of Patent: Mar. 30, 2010

(54) COMPRESSOR

(75) Inventor: Bahram Nikpour, Huddersfield (GB)

(73) Assignee: Holset Engineering Company, Limited, Huddersfield (GB)

( * ) Notice: Subject to any disclaimer, the term of this patent is extended or adjusted under 35 U.S.C. 154(b) by 148 days.

(21) Appl. No.: 12/148,667

(22) Filed: Apr. 21, 2008

(65) Prior Publication Data

US 2008/0232959 A1 Sep. 25, 2008

Related U.S. Application Data

(63) Continuation of application No. 11/061,993, filed on Feb. 21, 2005, now abandoned.

(30) Foreign Application Priority Data

Feb. 21, 2004 (GB) ..... 0403869.1

(51) Int. Cl.
*F04D 29/30* (2006.01)

(52) U.S. Cl. ..... 416/223 A; 416/223 B

(58) Field of Classification Search ..... None
See application file for complete search history.

(56) References Cited

U.S. PATENT DOCUMENTS

| | | | | |
|---|---|---|---|---|
| 4,273,512 | A | 6/1981 | Weiler | |
| 4,503,684 | A | 3/1985 | Mount et al. | |
| 4,543,041 | A | 9/1985 | French et al. | |
| 4,721,435 | A | 1/1988 | Kuah | |
| 4,743,161 | A | 5/1988 | Fisher et al. | |
| 4,834,611 | A | 5/1989 | Meng | |
| 4,990,053 | A | 2/1991 | Rohne | |
| 5,145,317 | A * | 9/1992 | Brasz | 415/224.5 |
| 5,246,335 | A | 9/1993 | Mitsubori et al. | |
| 5,333,990 | A | 8/1994 | Foerster et al. | |
| 6,164,931 | A | 12/2000 | Norton et al. | |
| 6,345,503 | B1 | 2/2002 | Gladden | |
| 6,623,239 | B2 | 9/2003 | Sahay et al. | |
| 6,663,347 | B2 | 12/2003 | Decker et al. | |
| 6,726,441 | B2 | 4/2004 | Sumser et al. | |
| 2002/0106274 | A1 | 8/2002 | Sumser et al. | |
| 2005/0002782 | A1 | 1/2005 | Nikpour et al. | |
| 2005/0163606 | A1 | 7/2005 | Svihla et al. | |

FOREIGN PATENT DOCUMENTS

| | | |
|---|---|---|
| EP | 0 526 387 A1 | 2/1993 |
| EP | 0 547 535 A1 | 6/1993 |
| GB | 544440 | 4/1942 |

(Continued)

*Primary Examiner*—Richard Edgar
(74) *Attorney, Agent, or Firm*—Krieg DeVault LLP; J. Bruce Schelkopf, Esq.

(57) ABSTRACT

A compressor comprises an impeller (1) provided with a plurality of radial blades (4). The impeller (1) has an inducer diameter defined by the outer diameter of front edges (5) of the blades (4), and an outer diameter defined by the outer diameter of the blade tips (6). Each blade (4) is backswept relative to the direction of rotation of the impeller (1) with an angle of backsweep in the range 45° to 55°. The ratio of the impeller inducer diameter to the impeller outer diameter is in the range 0.59 to 0.63. The ratio of the compressor diffuser outlet diameter to the impeller outer diameter is between 1.4 and 1.55.

8 Claims, 4 Drawing Sheets

FOREIGN PATENT DOCUMENTS

| | | | |
|---|---|---|---|
| GB | 940922 | | 11/1963 |
| GB | 2 202 585 | A | 9/1988 |
| GB | 2 319 809 | A | 6/1998 |
| WO | WO 2004/101968 | A2 | 11/1994 |
| WO | WO 98/16747 | | 4/1998 |
| WO | WO 2004101968 | A2 * | 11/2004 |

* cited by examiner

COMPRESSOR

The present application is a continuation of U.S. patent application Ser. No. 11/061,993 filed on Feb. 21, 2005 now abandoned which claims the benefit of United Kingdom Patent Application No. GB0403869.1 filed Feb. 21, 2004. Each of the above applications is incorporated herein by reference.

The present invention relates to a compressor. In particular, the invention relates to a centrifugal compressor such as, for example, the compressor of a turbocharger.

A compressor comprises an impeller, carrying a plurality of blades (or vanes) mounted on a shaft for rotation within a compressor housing. Rotation of the impeller causes gas (e.g. air) to be drawn into the impeller and delivered to an outlet chamber or passage. In the case of a centrifugal compressor the outlet passage is in the form of a volute defined by the compressor housing around the impeller. Gas flows through the impeller to the outlet volute via an annular outlet passage referred to as the diffuser. The diffuser has an upstream annular inlet surrounding the impeller and a downstream annular outlet opening into the volute.

In a conventional turbocharger for example the impeller is mounted to one end of a turbocharger shaft and is rotated by an exhaust driven turbine wheel mounted within a turbine housing at the other end of the turbocharger shaft. The shaft is mounted for rotation on bearing assemblies housed within a bearing housing positioned between the compressor and the turbine housing.

In more detail, a conventional compressor impeller comprises a back plate supporting an array of blades about a central hub. The blades extend generally axially from the back plate and radially from the hub, tapering from a relatively long base at the hub to a relatively short tip which sweeps around the diffuser inlet.

Each impeller blade can be regarded as having a back edge where the blade is supported by the back plate of the impeller, a front edge extending generally radially from the hub and a curved edge defined between the front edge and the tip. The curved edge sweeps across a wall of the compressor housing between the compressor inducer (inlet) and diffuser. The diameter of the front of the impeller, defined by the front edges of the blades, is referred to as the impeller inducer diameter. The ratio of the impeller inducer diameter to the impeller outer diameter (defined by the blade tips) is referred to as the "squareness" of the impeller. The ratio of the outer diameter of the impeller to the diffuser outlet diameter is referred to as the diffuser radius ratio. Conventional compressors typically have a diffuser radius ratio in the range of 1.6 to 2.0 and conventional impeller wheels typically have a squareness in the range of 0.64 to 0.71.

It is usual for compressor impeller blades to be backswept relative to direction of rotation of the impeller. That is, cache blade is curved backwards relative to the direction of rotation of the impeller. The angle of backsweep at any point on a blade surface is the angle defined between a tangent to the blade surface at that point in a plane normal to the axis and a radial line extending through the axis of the wheel. Impeller blades generally curve from the base to the tip so that the angle of backsweep varies across the surface of the blade. Conventional impeller blades typically have a backsweep angle in the range of between 30° and 40° measured at any point on the blade surface.

It is also conventional for impeller blades to be raked backwards having regard to the direction of rotation of the impeller. That is, the back edge of each blade (defined where the blade meets the back disc) lies behind the front edge of the blade (relative to the direction of rotation) so that the tip of the blade (and normally the base), is skewed relative to the axis of the impeller. The angle of rake at any point on a blade surface is the angle between a tangent to a line defined by a constant radius cross section through a blade and a line parallel to the impeller axis. Impeller blades may be curved so that the angle of rake varies from the base of the blade to the tip. Conventional impellers typically have a rake angle between 0 and 35° at any point on the blade surface.

For instance, a blade with a constant 0° rake angle extends from the impeller backplate in a direction parallel to the axis of the impeller wheel (note however that such a blade does not necessarily extend strictly radially as it may well be swept backwards as mentioned above). A blade with a 0° rake angle at its base and a 20° rake angle at its tip will have a base lying along the axis of the impeller and a tip edge lying at a 20° angle to the axis.

Compressor performance can be characterised by plotting changes in pressure ratio across the compressor (that is outlet pressure/inlet pressure) for different gas mass flow rates through the compressor at different impeller rotational speeds. The plot of the pressure ratio against flow rate for a variety of rotational speeds is known as a "compressor map". It is also common to include with a compressor map a plot of the compressor efficiency against mass flow rate through the compressor at maximum operating speed.

The map of any particular compressor is bounded by a surge line and a choke line. The surge line is defined by pressure ratio/mass flow rate points at which the compressor will surge for a range of impeller speeds. This is the low flow operating limit of the compressor. The choke line is defined by pressure ratio/mass flow rate points at which the compressor will choke for a range of impeller speeds. This represents the maximum flow capacity of the compressor for any impeller speed. The maximum pressure ratio available from the compressor is normally the surge point of the maximum speed line. The available mass flow range between the surge line and choke line is referred to as the "map width".

Compressor operation is extremely unstable under surge conditions due to large fluctuations in pressure and mass flow rate through the compressor. For many applications, such as in a turbocharger where the compressor supplies air to a reciprocating engine, such fluctuations in mass flow rate are unacceptable. As a result there is a continuing requirement to extend the usable flow range of compressors, in particular by improving surge margin.

Whereas in the past engine manufactures have had little interest in compressor performance above a pressure ratio of about 3:1, increasingly stringent emissions requirements placed upon engine manufacturers are forcing manufacturers to consider operating turbochargers at higher pressure ratios, above 3:1. It is an object of the present invention to provide a novel compressor which provides improved performance, in particular improved surge margin and efficiency, at higher pressure ratios. In the case of a compressor for a reciprocating engine turbocharger such improved efficiency will lead to reduction in fuel consumption when operating at higher pressure ratios.

According to a present invention there is provided a compressor for compressing a gas, the compressor comprising:

an impeller mounted for rotation about an axis within a chamber defined by a housing;

the housing having an axial intake and an annular outlet volute;

the chamber having an axial inlet and an annular outlet;

said axial inlet being defined by a tubular inducer portion of the housing and said annular outlet being defined by an annular diffuser passage surrounding the impeller, the diffuser having an annular outlet communicating with the outlet volute;

the impeller comprising a plurality of blades each having a front edge rotating within the housing inducer portion, a tip sweeping across the annular inlet of the diffuser, and a curved edge defined between the front edge and the tip which sweeps across a surface of the housing defined between the inducer and the diffuser;

the impeller having an inducer diameter defined by the outer diameter of the front edges of the blades, and an outer diameter defined by the outer diameter of the blade tips;

each blade being backswept relative to the direction of rotation of the impeller about said axis;

wherein the angle of backsweep at any point on a blade surface is in the range 45° to 55°;

wherein the ratio of the impeller inducer diameter to the impeller outer diameter is in the range 0.59 to 0.63;

and wherein the ratio of the diffuser outlet diameter to the impeller outer diameter is between 1.4 and 1.55.

It has been found that the combination of unusually low impeller squareness, together with an unusually high impeller blade backsweep angles and an unusually low diffuser radius ratio, provides significant improvement in the flow range (in particular surge margin) at high pressure ratios as well as increased efficiency at high operating speeds. In the context of a turbocharger compressor supplying air to an internal combustion engine, the improved efficiency leads to reduced fuel consumption. Embodiments of the invention have shown an increase in flow range of up to 30% at pressure ratios above 3:1 compared with conventional compressors, and up to a 5% improvement in compressor efficiency at maximum speed running of the compressor.

Adoption of the design parameters of the present invention runs counter to conventional compressor design procedures. For instance, in modern compressor design, particularly for compressors to be fitted to vehicles, there is emphasis on reduced size and weight. Adopting an unusually low impeller squareness, in accordance with the present invention, increases the overall size of the impeller (for a given flow/inducer diameter) as compared with a conventional design. However, any adverse impact of this increased size is more than compensated for by the improvement in performance. Similarly, the adoption of unusually high backsweep angles (and in preferred embodiments rake angles) leads to more complex tooling and manufacturing procedures which leads to increased expense compared to a conventional impeller. However, again the improvement in performance more than compensates for the increased complexity and manufacturing costs.

In some embodiments of the invention the average angle of backsweep of each blade may be between 50° and 55°.

It is also preferred that each impeller blade is raked backwards relative to the direction of rotation of the impeller, preferably at an angle in the range of 35° to 55°. In some embodiments of the invention the average rake angle of each blade is in the range of 35° to 40°.

It should be noted that in addition to variations in backsweep angle, and possibly rake angle, the cluster surface of an impeller blade which at present by design, there may also be local variations as a result of variations of thickness along a blade. Accordingly, it is conventional to specify angles of backsweep and rake assuming a blade of zero thickness. Accordingly, angles specified in this specification relate to such "zero" thickness blades and may in practice be subject to some minor variation as a result of varying blade thickness.

In some turbochargers the compressor inlet has a structure that has become known as a "map width enhanced (MWE)" structure. An MWE structure is described for instance in U.S. Pat. No. 4,743,161. The inlet of such an MWE compressor comprises two coaxial tubular inlet sections, an outer inlet section forming the compressor intake and an inner inlet section defining the compressor inducer, or main inlet. The inner inlet section is shorter than the outer inlet section and has an inner surface which is an extension of a surface of an inner wall of the compressor housing which is swept by the curved edges of the impeller blades. An annular flow path is defined between the two tubular inlet sections which is open at its upstream end (relative to the intake) and is provided with apertures at its downstream end (relative to the intake) which communicate with the inner surface of the compressor housing which faces the impeller.

In operation the pressure within the annular flow passage surrounding the compressor inducer is normally lower than atmospheric pressure. During high gas flow and high speed operation of the impeller the pressure in the area swept by the impeller is less than that in the annular passage. Thus, under such conditions air flows inward from the annular passage to the impeller wheel thereby increasing the amount of air reaching the impeller wheel, and increasing the maximum flow capacity (choke limit) of the compressor.

However, as the flow through the impeller drops, or as the speed of the impeller drops, so the amount of air drawn into the impeller through the annular passage decreases until the pressure reaches equilibrium. A further drop in the impeller gas flow or speed results in the pressure in the area swept by the impeller wheel increasing above that within the annular passage so that there is a reversal in the direction of air flow through the annular passage. That is, under such conditions air flows outward from the impeller to the upstream end of the annular passage and is returned to the compressor intake for re-circulation.

Increasing gas flow through the impeller, or impeller speed, causes the reverse to happen, i.e. a decrease in the amount of air returned to the intake through the annular passage, followed by equilibrium, in turn followed by reversal of the air flow through the annular passage so that air is drawn into the impeller wheel via the apertures communicating between the annular passage and the impeller.

It is well known that this MWE arrangement stabilises the performance of the compressor increasing the maximum flow capacity and improving the surge margin, i.e. decreasing the flow at which the compressor surges over a range of compressor speeds. Since both the maximum flow capacity (choke flow) and surge margin are improved the width of the compressor map increases. Hence the term "map width enhanced" compressor.

Application of the present invention to an otherwise conventional MWE compressor delivers a further improvement in surge margin, particularly at high pressure ratios, as well as increased efficiency.

Other preferred and advantageous features of the invention will be apparent from the following description.

Specific embodiments of the present invention will now be described, by way of example only, with reference to the accompanying drawings, in which.

Figure 1:
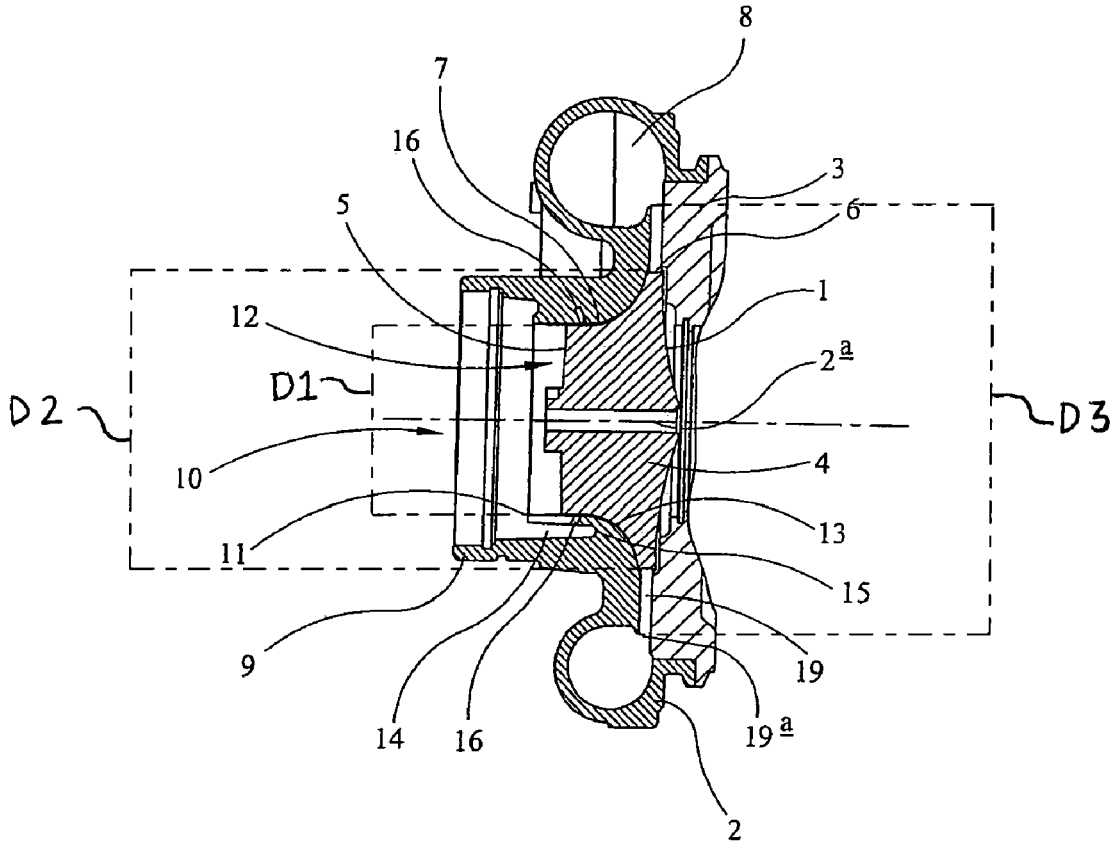
FIG. 1 is a cross-section through a generic MWE compressor housing and impeller.

Referring to FIG. 1, this illustrates a cross-section of generic MWE compressor of a general design typically included in a turbocharger. The compressor comprises an impeller 1 mounted within a compressor housing 2 on one end of a rotating shaft (not shown) extending along an axis 2*a*. The shaft (not shown) extends through a bearing housing, part of which is indicated at 3, to a turbine housing (not shown). The impeller has a plurality of blades 4 each of which has a front edge 5, a tip 6 and a curved edge 7 extending between the front edge 5 and tip 6. The impeller is described in more detail below with reference to FIGS. 2 and 3.

The compressor housing 2 defines an outlet volute 8 surrounding the impeller 1, and an MWE inlet structure comprising an outer tubular wall 9 extending upstream of the impeller 1 and defining an intake 10 for gas (such as air), and an inner tubular wall 11 which extends part way into the intake 10 and defines the compressor inducer 12. The inner surface of the inner tubular wall 11 is an upstream extension of a housing wall surface 13 which is swept by the curved edges 7 of the impeller blades 4. An annular flow passage 14 surrounds the inducer 12 between the inner and outer walls 11 and 9 respectively. The flow passage 14 is open to the intake 10 at its upstream end and is closed its downstream end by an annular wall 15 of the housing 2. The annular passage 14 however communicates with the impeller 1 via apertures 16 formed through the housing (through the tubular inner wall 11 in this instance) and which communicate between a downstream portion of the annular flow passage 14 and the inner surface 13 of the housing 2 which is swept by the curved edges 7 of the impeller blades 4.

An annular passage, known as the diffuser 19, is defined by the housing 2 around the impeller blade tips 6 and has an annular outlet 19*a* communicating with the volute 8.

The conventional MWE compressor illustrated in FIG. 1 operates as is described above. In summary, when the flow rate through the compressor is high, air passes axially along the annular flow path 14 towards the impeller 1, flowing to the impeller through the apertures 16. When the flow through the compressor is low, the direction of air flow through the annular passage 14 is reversed so that air passes from the impeller 1, through the apertures 16, and through the annular flow passage 14 in an upstream direction and is reintroduced into the air intake 10 for re-circulation through the compressor. This stabilises the performance of the compressor improving both the surge margin and choke flow.

Figure 2:
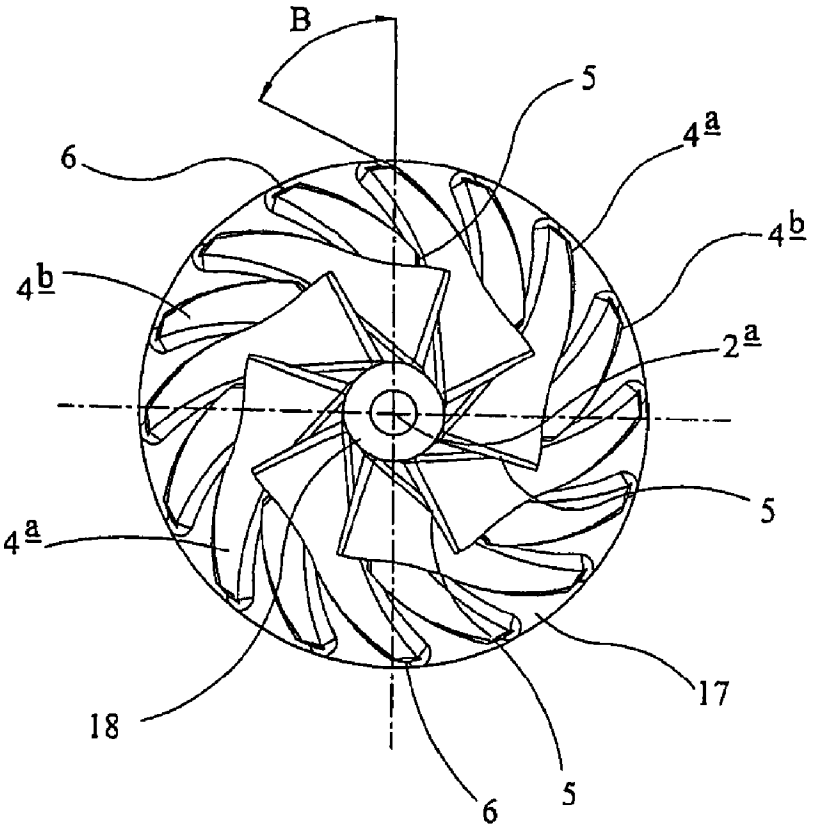
FIG. 2 is a front view of the compressor impeller of FIG. 1.
Figure 3:
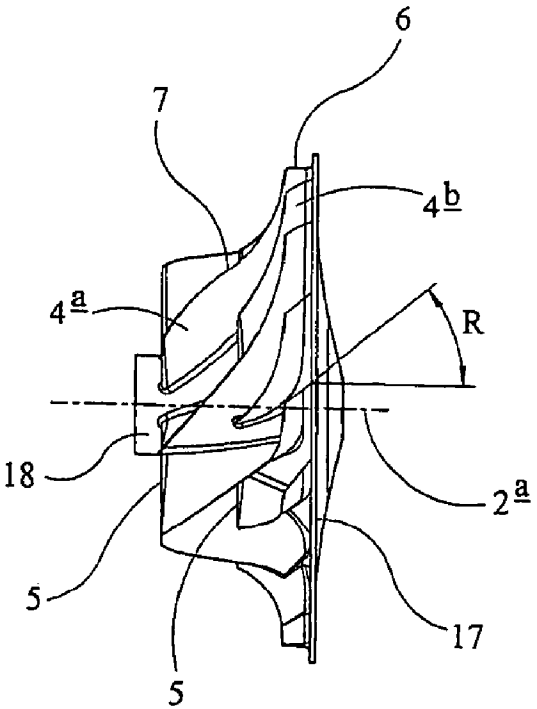
FIG. 3 is a side view of the impeller of FIG. 1.

Turning now to FIGS. 2 and 3, these illustrate features of the impeller 1 in more detail. It can be seen that the blades 4 comprise main blades 4*a* and smaller intermediate "splitter" blades 4*b*. The blades 4 are supported by a backplate 17 around a central impeller hub 18. The front edge 5 of each blade extends generally radially to the axis 2*a* of the impeller, the maximum diameter defined by the front edges 5 being known as the inducer diameter of the impeller. The outer diameter of the impeller is defined by the diameter of the blade tips 6.

The impeller inducer diameter is marked as D1 on FIG. 1 and the impeller outer diameter is marked as D2 on FIG. 1. The diffuser outlet diameter is marked as D3 on FIG. 1.

As mentioned in the introduction to the specification, the ratio of the impeller inducer diameter D1 to the impeller outer diameter D2 is referred to as the "squareness" of the impeller. The ratio of the diffuser outlet diameter D3 to the impeller outer diameter D2 is referred to as the diffuser radius ratio. Conventional turbocharger compressors typically have an impeller with a squareness in the range 0.64 to 0.71 and a diffuser radius ratio in the range 1.6 to 2.0. However, in accordance with the present invention the squareness is in the range 0.59 to 0.63 and the diffuser radius ratio is in the range 1.4 to 1.55.

Also apparent from FIG. 2 and FIG. 3 is the backsweep of the impeller blades 4. The angle of backsweep is measured between a radial line extending through the axis of the impeller and a line extending at a tangent to the blade surface at a given point, and lying in a plane normal to the axis (i.e. parallel to the back plate 17). In FIG. 2 the backsweep angle B measured at the tip of a blade is shown. Due to curvature of each blade, the backsweep angle may vary along the surface of the blade but for conventional turbocharger compressors the backsweep angle at any point of the surface of the blade typically lies between 30° to 40°. However, with the present invention the backsweep angle measures at any point on the surface of the blade that lies in the range of 45° to 55°.

FIG. 2, and in particular FIG. 3, also illustrate the rake angle of the impeller blades 4. As mentioned above, the rake angle of a blade at any point on the blade surface can be measured between a line parallel to the axis of the impeller and a line tangential to the blade at that point in a direction defined by a radial cross-section through the blade. Because of the typical curvature of the impeller blades 5, the rake angle may change across the surface of a blade. FIG. 3 illustrates the rake angle R measured at the tip of a blade 5. Conventional turbocharger compressors typically have a back rake angle between 0° and 35°. Compressors in accordance with the present invention may have a back rake angle within this range, but it is preferred that the back rake angle is in the range of 35° to 55°.

Figure 4:
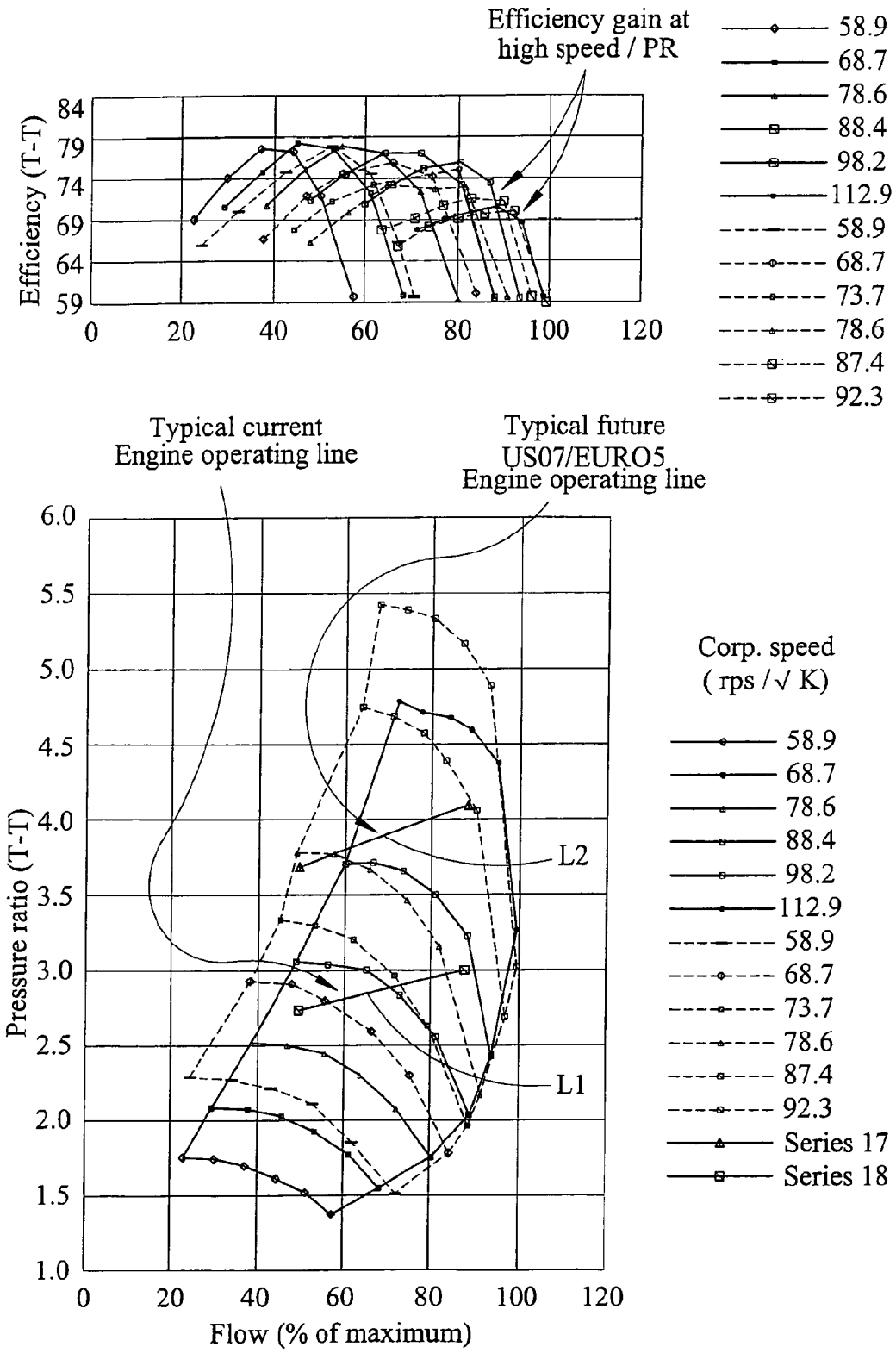
FIG. 4 is an over-plot comparing the performance map of a conventional compressor with a compressor in accordance with a first embodiment of the present invention.

FIG. 4 is an over-plot of the performance of a first embodiment of a compressor according to the present invention (the plot shown in dotted lines), in comparison with the performance of a conventional MWE compressor (the plot shown in solid lines). The conventional compressor has blades with an average backsweep angle of 40° and a rake angle of 35°. The impeller has a squareness of 0.68 and the compressor has a diffuser radius ratio of 1.65. Each of the impeller blades of the embodiment of the present invention has an average impeller backsweep angle of about 52° (the backsweep angle varies between 48.5° and 55° across each blade surface). The rake angle is substantially constant at 40° (subject to variations due to varying blade thickness). The impeller has a squareness of 0.6 and the diffuser radius ratio is 1.52.

The lower plot is the performance map which, as is well known, plots air flow rate through the compressor against pressure ratio from the compressor inlet to outlet for a variety of impeller rotational speeds. The flow axis is normalised to 100%. As discussed above, the left hand line of the map represents the flow rates at which the compressor will surge for various turbocharger speeds and is known as the surge line. It can be seen that the compressor according to the present invention has a significantly improved surge margin compared to the surge margin of the conventional compressor. The maximum flow (choke flow) is largely unaffected (shown by the right hand line of the map).

The surge margin is increased over a range of pressure ratios and in particular is significantly increased at high pressure ratios above 3:1. It can also be seen that the flow capacity of the compressor at maximum operating speed is increased compared with the conventional compressor. Specifically, the surge margin is increased by up to 20% at high pressure ratio, and the pressure ratio capability is increased by up to 15% ratio. Superimposed on the compressor map are two engine operating lines L1 and L2. L1 represents the running conditions of a typical conventional turbocharged diesel engine whereas L2 shows the running conditions of a typical turbocharged diesel engine being developed to meet new emission targets. This clearly shows the advantages of the present invention when incorporated in a turbocharger for a diesel engine designed to meet new emission regulations.

The upper plot of FIG. 4 plots the compressor efficiency as a function of air flow. Again, the plot relating to the embodiment of the present invention is shown in dashed lines. It can be seen that at high operating speeds the present invention provides an improvement in efficiency (up to 3% at high pressure ratios).

Figure 5:
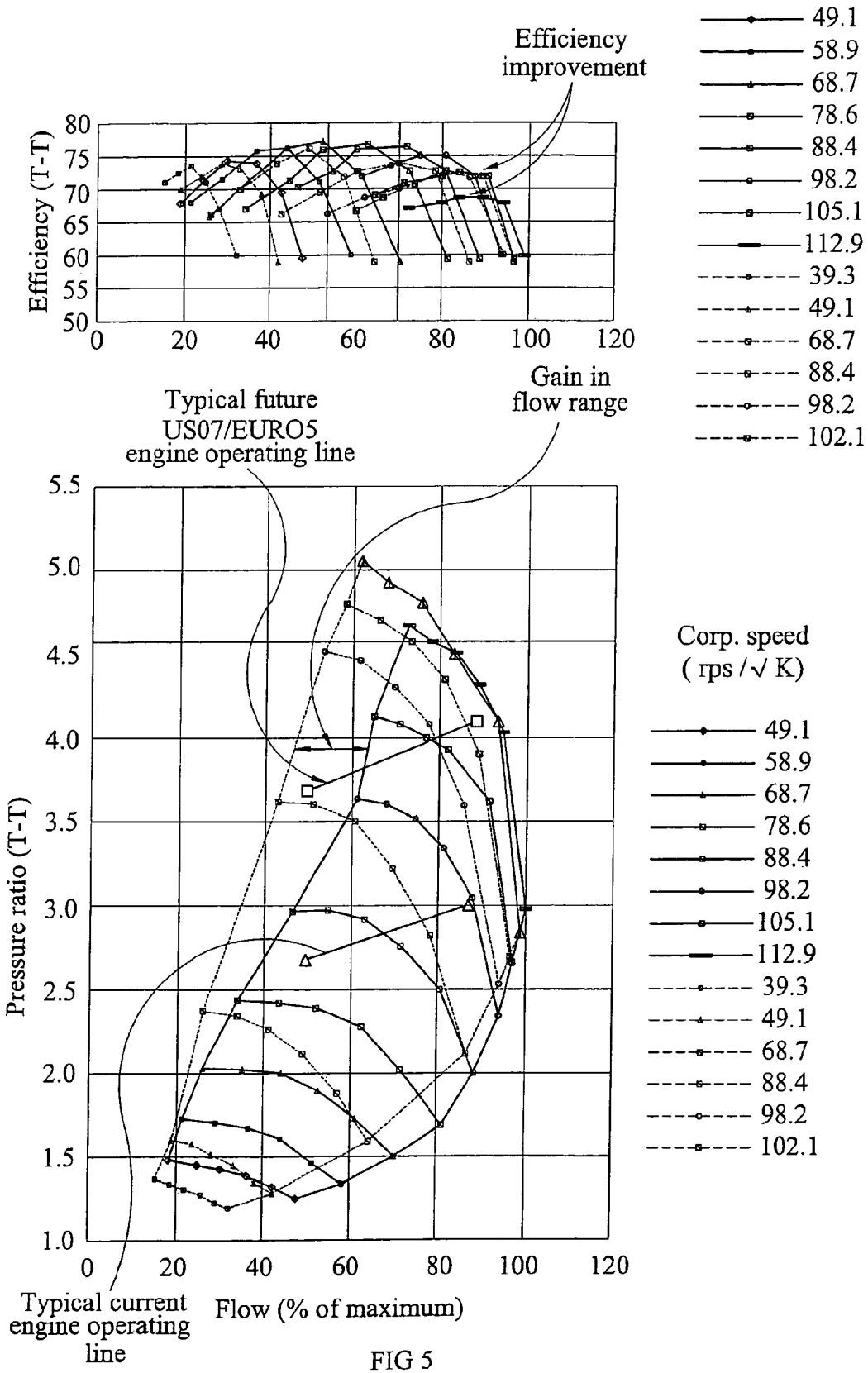
FIG. 5 is an over-plot comparing the performance map of a conventional compressor with a compressor according to a second embodiment of the present invention.

FIG. 5 is a an over-plot of the compressor map of a second embodiment of the present invention, in comparison with the same conventional MWE compressor as used for the comparison of FIG. 4. In this case, the compressor in accordance with the present invention has impeller blades with a backsweep angle varying between 51° and 55° across each blades surface giving an average backsweep angle of about 53°. The rake angle is substantially constant at 35°. The impeller has a squareness of 0.63 and the compressor diffuser radius ratio is 1.4. Again, improvements in surge margin, maximum flow at maximum operating speed, and efficiency at maximum operating speed can be seen. Again it can be seen that the most significant increase in surge margin is obtained at high pressure ratios above about 3:1. In this case surge margin is improved by up to 30%, pressure ratio capability is improved by up to 7%, and efficiency at high pressure ratio is increased by up to 5%. Again, engine operating conditions for a conventional turbocharged diesel engine and for a typical next generation diesel engine are illustrated by lines L1 and L2 respectively.

Although compressors according to the present invention have particular utility as part of a turbocharger, other applications will be apparent to the readily skilled person. Similarly, possible modifications to the detailed structure as described above will be readily apparent to the appropriately skilled person.

The invention claimed is:

1. A compressor for compressing a gas, the compressor comprising:

an impeller mounted for rotation about an axis within a chamber defined by a housing;

the housing having an axial intake and an annular outlet volute;

the chamber having an axial inlet and an annular outlet;

said axial inlet being defined by a tubular inducer portion of the housing and said annular outlet being defined by an annular diffuser passage surrounding the impeller, the diffuser having an annular outlet communicating with the outlet volute;

the impeller comprising a plurality of blades each having a front edge rotating within the housing inducer portion, a tip sweeping across the annular inlet of the diffuser, and a curved edge defined between the front edge and the tip which sweeps across a surface of the housing defined between the inducer and the diffuser;

the impeller having an inducer diameter defined by the outer diameter of the front edges of the blades, and an outer diameter defined by the outer diameter of the blade tips;

each blade being backswept relative to the direction of rotation of the impeller about said axis;

wherein the angle of backsweep at any point on a blade surface is in the range 45° to 55°;

wherein the ratio of the impeller inducer diameter to the impeller outer diameter is in the range of 0.59 to 0.63;

and wherein the ratio of the diffuser outlet diameter to the impeller outer diameter is between 1.4 and 1.55.

2. A compressor according to claim 1, wherein the angle of backsweep is between 48° and 55°.

3. A compressor according to claim 1, wherein the average angle of backsweep measured across the surface of a blade is in the range of 50° and 55°.

4. A compressor according to claim 1, wherein each blade is raked backwards relative to the direction of rotation of the impeller about said axis.

5. A compressor according to claim 4, wherein the angel of back rake measured at any point on the surface of a blade is in the range of 35° to 55°.

6. A compressor according to claim 5, wherein the angle of back rake of each blade is substantially constant.

7. A compressor according to claim 6, wherein the angle of rake is in the range of 35° to 40°.

8. A compressor according to claim 1, wherein the housing defines an inlet comprising an outer tubular wall extending away from the impeller in an upstream direction forming a gas intake portion of the inlet, and an inner tubular wall extending away from the impeller in an upstream direction within the outer tubular wall and defining said inducer portion of the housing;

an annular gas flow passage being defined between the inner and outer tubular walls and having an upstream end and a downstream end, the upstream end of the annular passage communicating with the intake or inducer portions of the inlet through at least one upstream aperture, the downstream end of the annular flow passage communicating with said surface of the housing swept by the curved edges of the impeller blades through at least one downstream aperture.

* * * * *